US005295731A

United States Patent [19]

Dauphin

[11] Patent Number: 5,295,731

[45] Date of Patent: Mar. 22, 1994

[54] CHAIR, IN PARTICULAR OFFICE CHAIR

[75] Inventor: Friedrich W. Dauphin, Offenhausen, Fed. Rep. of Germany

[73] Assignee: Friedrich W. Dauphin GmbH & Co. Entwicklungs- und Beteiligungs-KG, Neukirchen, Fed. Rep. of Germany

[21] Appl. No.: 870,845

[22] Filed: Apr. 20, 1992

[30] Foreign Application Priority Data

Apr. 20, 1991 [DE] Fed. Rep. of Germany ... 9104854[U]

[51] Int. Cl.[5] ..... A47C 3/28; A47C 3/40; A47C 7/00

[52] U.S. Cl. ..... 297/440.16; 297/301; 297/353; 297/440.21; 403/109; 403/110

[58] Field of Search ..... 297/443, 444, 353, 300, 297/301, 302, 440.16, 440.21; 403/109, 110

[56] References Cited

U.S. PATENT DOCUMENTS

| | | | |
|---|---|---|---|
| 3,656,593 | 4/1972 | Bauer | 297/355 |
| 3,711,054 | 1/1973 | Bauer | 297/345 |
| 4,662,680 | 5/1987 | Dauphin | 297/300 |
| 4,854,641 | 8/1989 | Reineman et al. | 297/353 |
| 4,890,888 | 1/1990 | Kostin | 297/443 |
| 4,921,303 | 5/1990 | White | 403/110 |
| 4,966,412 | 10/1990 | Dauphin | 297/301 |
| 5,135,284 | 8/1992 | Crum | 297/443 |

FOREIGN PATENT DOCUMENTS

| | | | |
|---|---|---|---|
| 155059 | 12/1920 | United Kingdom | 297/353 |

*Primary Examiner*—Alexander Grosz
*Attorney, Agent, or Firm*—Browdy and Neimark

[57] ABSTRACT

A chair, in particular office chair, comprises a seat support, which carries a seat, and a back rest, which is provided with a rod-shaped back rest support, which in turn is releasably connected with the rear end of the seat support. In order to embody the connection of the back rest with the seat support such that it can be made or released in a simple manner with regard to design and very quickly, a clamping device is formed at the rear end of the seat support, which clamping device has a receiving sleeve which can be clamped together and which receives the rod-shaped back rest support.

2 Claims, 3 Drawing Sheets

CHAIR, IN PARTICULAR OFFICE CHAIR

FIELD OF THE INVENTION

The invention relates to a chair, in particular office chair, comprising a seat support, which carries a seat, a back rest, which has a rod-shaped back rest support, which is releasably connected with the rear end of the seat support.

BACKGROUND OF THE INVENTION

With chairs of this type the back rest is among other reasons releasably connected with the seat support, in order to be able to pack the chair as a whole very compactly for storage and for dispatch. The subsequent final assembly for the user is supposed to be carried out even by untrained staff in a very quick and reliable manner. Beyond that, the connection between back rest and seat support should be firm and secure and should be capable of being made in a simple manner with regard to design and at low expenses.

SUMMARY OF THE INVENTION

It is accordingly the object of the invention to embody a chair of the generic type such that the connection of the back rest with the seat support can be made or released in a simple manner with regard to design and very quickly.

This object is attained in accordance with the invention by a clamping device being formed at the rear end of the seat support, which clamping device has a receiving sleeve which can be clamped together and which receives the rod-shaped back rest support. In accordance with the invention the back rest support is merely pushed into the receiving sleeve of the clamping device, which is then clamped together. The further improvement, according to which the rod-shaped back rest support has a conical section in the region of its lower end which tapers towards this end and in which the receiving sleeve has lateral walls adapted in conical angle to this conical section, ensures a very simple assembly and that in particular together with the measures, according to which the receiving sleeve has a receiving section which is similar to the conical section, as it can be assured hereby that the back rest support arrives reliably in a predetermined height position when being pushed into the receiving sleeve, so that also the height position of the back rest itself to the seat support and thus to the seat lies in a predetermined region.

Further features, advantages and details of the invention will become apparent from the ensuing description of an example of embodiment taken in conjunction with the drawing.

DESCRIPTION OF THE PREFERRED EMBODIMENTS

Figure 1:
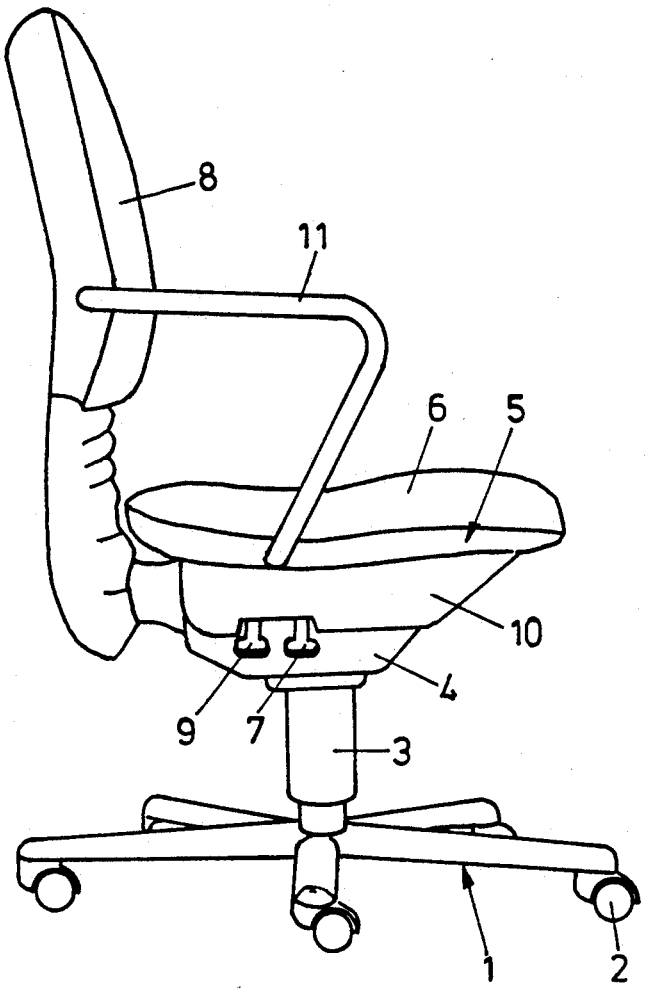
FIG. 1 shows a chair in a side view.

An office chair shown in FIG. 1 has a pedestal 1, which is supported on the floor by means of casters 2.

At the pedestal 1 a chair column 3 which is adjustable in height is disposed, to the upper end of which a seat support 4 is releasably secured, on which a seat 5 is disposed, which is provided with a seat padding 6. The height of the chair column 3 is adjusted by means of an operating lever 7 which is fixed in the seat support 4. A further operating lever 9 is fixed at the seat support 4 for the purpose of changing the tilt of a back rest 8 while simultaneously changing the tilt of the seat 5. The seat support 4 can be optically concealed partially or substantially by a casing 10 secured to the lower side of the seat 5. The chair is provided with armrests 11, which are disposed on the one hand in the region of the front side of the seat 5 and on the other hand in the middle part of the height of the back rest 8.

Figure 2:
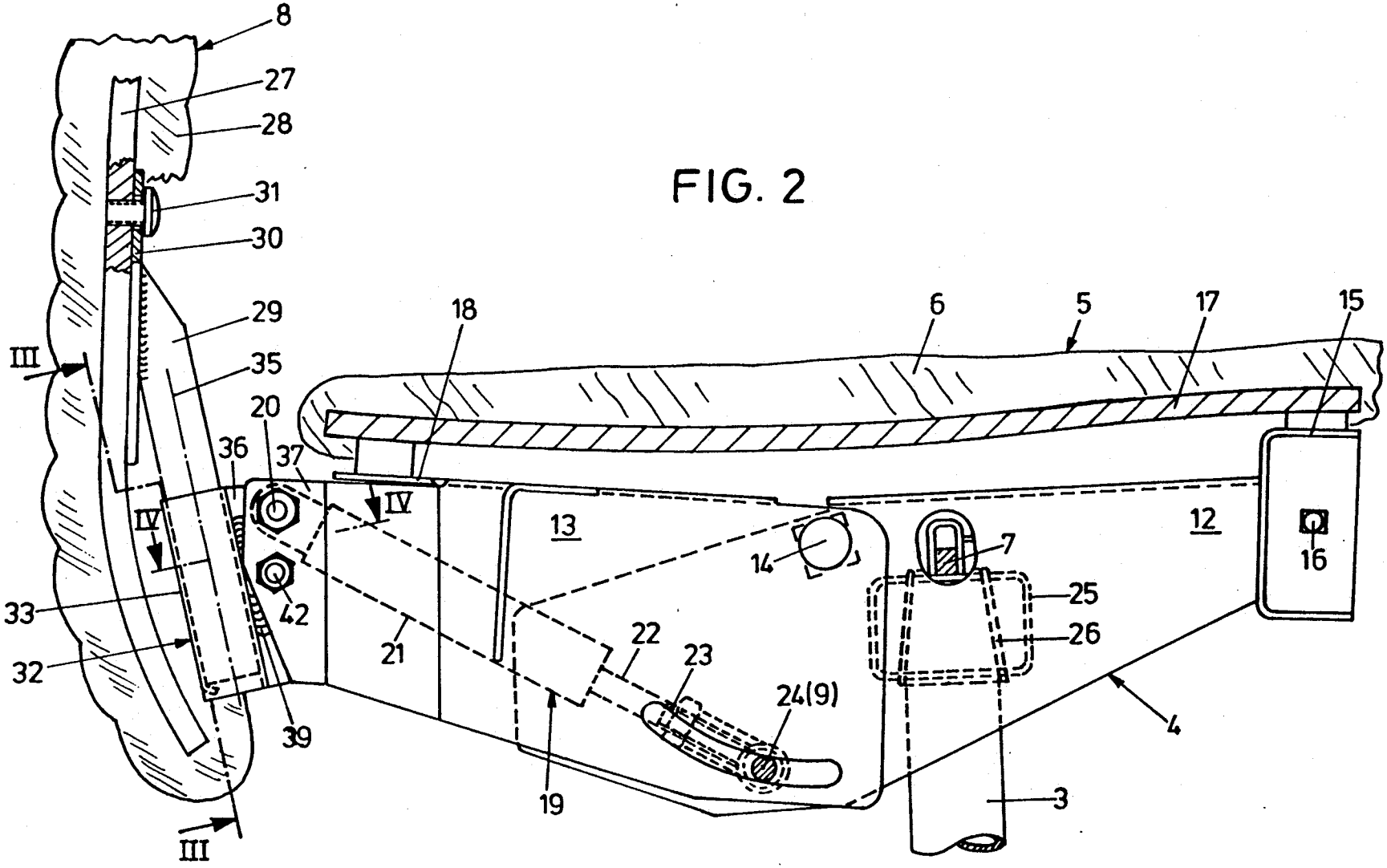
FIG. 2 shows a vertical longitudinal section through a seat support with a part of the back rest of the chair.

As can be seen from FIG. 2, the seat support 4 is of divided construction. It consists of a front seat support member 12 and of a rear seat support member 13. The two seat support members 12, 13 formed as C-profiles are interconnected by a pivot axis 14 located adjacent to their upper side. At the front end of the front seat support member 12 of the seat support 4 a front seat holder 15 is disposed pivotably around a pivot axis 16 which extends parallel to the pivot axis 14. On this front seat holder 15 a seat plate 17 which is rigid in itself is elastically supported and fixed and forms the core of the seat 5. In its rear region facing the back rest 8 it is also elastically supported and fixed on a rear seat holder 18.

At the rear end of the rear seat support member 13, a force storage means adjustable in length in the form of a gas spring 19 adjustable in length is articulated around a pivot axis 20, which extends parallel to the pivot axes 14, 16. The housing 21 of the gas spring 19 faces this pivot axis 20, from the other end of which housing 21 a piston rod 22 exits. From this piston rod 22 an actuation pin 23 protrudes, by means of which a valve located in the gas spring 19 can be actuated for the purpose of length adjustment. The piston rod 22 is connected by means of a thread with an actuation device 24, to which the operating lever 9 pertains.

In the front seat support member 12 a pillow block 25 is disposed, in which a downwardly widening conical sleeve 26 which is open at the bottom is formed. The chair column 3 is releasably fixed in this conical sleeve 26. The operating lever 7 is disposed above the pillow block 25. For length adjustments of the gas spring 19 the front and the rear seat support member 12 or 13 are pivoted in relation to each other around the pivot axis 14, whereby the front seat support member 12 does not change its position because of the rigid—even though releasable—connection with the chair column 3, i.e. the rear seat support member 13 changes its tilt. As a result the tilt of the seat plate 17 of the seat 5 is changed at the same time.

The chair column 3 adjustable in height is known for instance from U.S. Pat. No. 3,711,054 or from U.S. Pat. No. 3,656,593. The design of the seat support including the described pivoting possibilities is known for instance from U.S. Pat. No. 4,966,412. The design and disposition of the actuation device 24 and of the gas spring 19 are known from U.S. Pat. No. 4,662,680.

Figure 4:
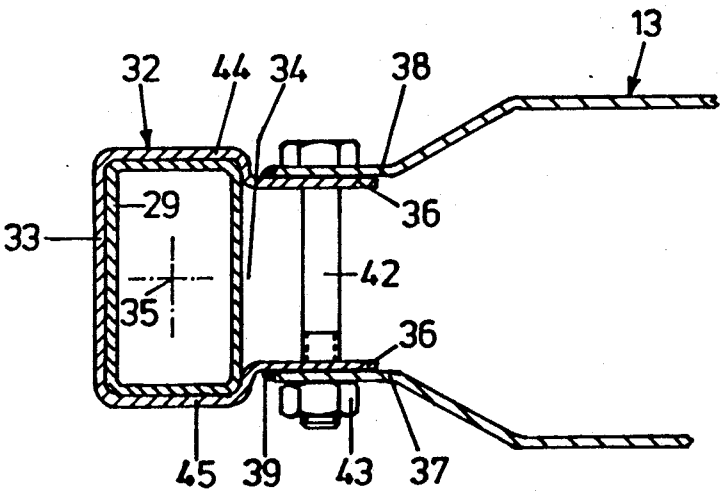
FIG. 4 shows a cross section through the clamping device of the chair according to the line IV—IV in FIG. 2.

The back rest 8 has a base plate 27, which serves as a support for a back rest padding 28. At the side, facing the seat support 5, of the base plate 27 a back rest support 29 is fixed, by means of a flange plate 30 which is firmly disposed at its upper end, by means of screws 31. The back rest support 29 is a hollow section rod with rectangular cross section, i.e. it is formed by a rectangular box section, as can be seen in particular from FIG. 4.

For receiving and retaining this back rest support 29 a clamping device 32 is disposed at the rear end of the rear seat support member 13. The clamping device 32 consists of a receiving sleeve 33 with an approximately C-shaped cross section, as can be seen from FIG. 4, which is open on top and which is welded on the rear end of the rear seat support member 13. The receiving sleeve 33 has an opening 34 on its side facing the rear seat support member 13, which opening 34 does not extend over the full width of the receiving sleeve 33, so that, as can be seen from FIG. 4, the back rest support 29 is secured in the cross section of the receiving sleeve 33, i.e. transversely of its longitudinal axis 35. In the vicinity of the opening 34 retaining flanges 36 extend from the receiving sleeve 33 to the rear region of the rear seat support member 13, which retaining flanges 36—as can be seen from FIG. 2—are connected with the lateral walls 37, 38 of the rear seat support member 13 by means of weld seams 39. The lateral walls 37, 38 are open on top at least in the region between the receiving sleeve 33 and the rear seat holder 18 extending sidewards like a supporting arm.

In the region of its lower end the back rest support 29 has a conical section 40 which tapers conically towards the end. The receiving opening 33 is embodied tapering conically from the top to the bottom over its entire axial extension, whereby this tapering is precisely adapted in its conical angle to the conical section 40. The receiving sleeve 33 has—also in its lower region—a receiving section 41, which is precisely adapted in cross section to the conical section 40 of the back rest support 29. The manufacture can be effected for example by means of a plug gauge. It is assured by this embodiment that the back rest support 29 when being inserted into the receiving sleeve 33 arrives precisely in a predetermined height position to the seat support 4, so that the height position of the back rest 8 in relation to the seat support 4 is always the same for each chair and corresponds to given data with regard to design in a reproduceable manner.

Figure 3:
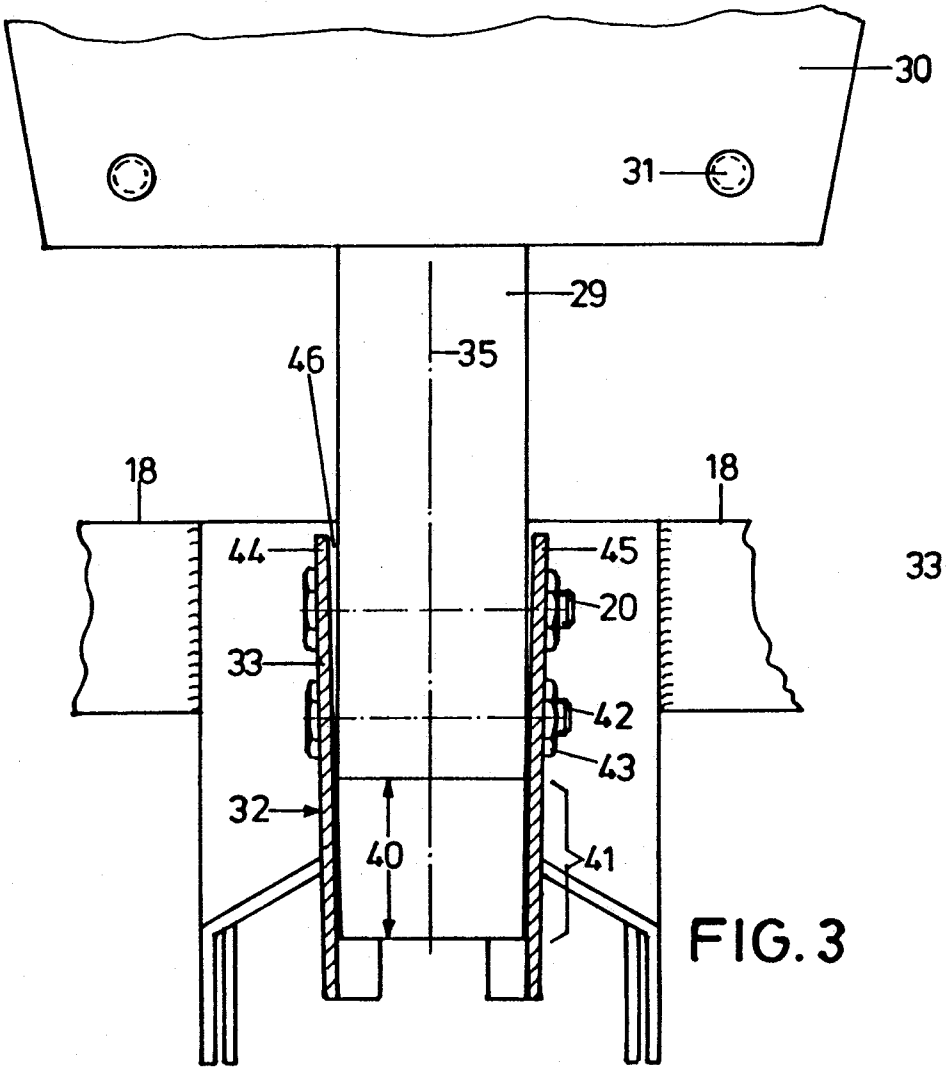
FIG. 3 shows a partial rear view of the back rest of the chair according to the line III—III in FIG. 2

Above the conical receiving section 41 a clamping screw 42 is provided in the region of the connection between the retaining flanges 36 and the lateral walls 37, 38, which clamping screw 42 runs parallel to the pivot axis 20 and is disposed below the latter. This clamping screw 42 passes through the retaining flange 36 and through the pertaining regions of the lateral walls 37, 38. When the nut 43 located on the clamping screw 42 is tightened, the retaining flanges 36 and the pertaining regions of the lateral walls 37, 38 are somewhat braced in direction towards each other, by means of which the lateral walls 44, 45, adjoining the retaining flanges 36 and being located opposite each other, of the receiving sleeve 33 are deformed in direction towards each other. Hereby they arrive from the position shown in FIG. 3, in which they form a gap 46 to the lateral walls 44, 45 above the receiving section 41, in a position resting at least approximately at the lateral walls 44, 45 of the receiving sleeve 33. By means of this in any case the receiving section 41 is deformed such that it keeps tightly between it the conical section 40 of the back rest support 29. By a corresponding releasing of the clamping screw 42 with nut 43 this clamping can be released as much that the back rest support 29, while releasing its conical section 40 in relation to the receiving section 41, can be drawn out of the latter.

As can be seen from FIG. 1 and FIG. 2, the base plate 27 with the back rest padding 28 extends as far as under the clamping device 32, so that the latter cannot be seen from the rear side. Also on the side facing the seat 5 the back rest padding can extend as far as near the rear end of the rear seat support member 13, in order to conceal the back rest support 29 in this manner. For reasons of graphic clearness the padding in this region is not shown in FIG. 2.

What is claimed is:

1. A chair, in particular office chair, comprising:

a seat support (4) having a rear end;

a seat (5) carried by said seat support (4);

a back rest (8);

and a rod-shaped back rest support (29) being part of the back rest (8) and being releasably connected with said rear end of said seat support (4);

wherein a clamping device (32) is formed at said rear end of said seat support (4), which clamping device (32) has a receiving sleeve (33) which receives said rod-shaped back rest support (29) and which is clampable together to hold said rod-shaped back rest support (29);

wherein said rod-shaped back rest support (29) has a lower end and a conical section (40) in the region of said lower end which conical section (40) tapers towards said lower end and wherein said receiving sleeve (33) has lateral walls (44, 45) which are adapted to said conical section (40);

wherein said receiving sleeve (33) has a receiving section (41) which is similar to said conical section (40);

wherein said receiving sleeve (33) is provided with retaining flanges (36) which protrude from said receiving sleeve (33) and which delimit an opening (34), which retaining flanges (36) are passed through by a clamping screw (42); and wherein said receiving sleeve (33) has a receiving section (41) which is similar to said conical section (40) and wherein said clamping screw (42) is disposed above said receiving section (41).

2. A chair according to claim 1, wherein said retaining flanges (36) are firmly connected with said rear end of said seat support (4).

* * * * *